US009330814B2

(12) United States Patent
Hisada et al.

(10) Patent No.: US 9,330,814 B2
(45) Date of Patent: May 3, 2016

(54) INSULATED ELECTRIC WIRE

(71) Applicants: DENSO COPORATION, Kariya-shi, Aichi (JP); UNIMAC LTD, Inabe-shi, Mie (JP)

(72) Inventors: Tomokazu Hisada, Anjo (JP); Yuki Amano, Aichi-ken (JP); Kazuomi Hirai, Inabe (JP); Yumi Kawachi, Inabe (JP); Masatoshi Narita, Inabe (JP); Tatsumi Hirano, Inabe (JP); Futoshi Kanemitsu, Inabe (JP); Yasunari Ashida, Inabe (JP)

(73) Assignees: Denso Corporation, Aichi (JP); Unimac Ltd., Mie (JP)

( * ) Notice: Subject to any disclaimer, the term of this patent is extended or adjusted under 35 U.S.C. 154(b) by 0 days.

(21) Appl. No.: 13/943,185

(22) Filed: Jul. 16, 2013

(65) Prior Publication Data

US 2014/0020929 A1 Jan. 23, 2014

(30) Foreign Application Priority Data

Jul. 20, 2012 (JP) ..... 2012-162117

(51) Int. Cl.
*H01B 3/30* (2006.01)
*H01B 7/02* (2006.01)
*H01F 27/28* (2006.01)

(52) U.S. Cl.
CPC ..... *H01B 7/0225* (2013.01); *H01B 3/306* (2013.01); *H01B 3/308* (2013.01); *H01F 27/2823* (2013.01); *Y10T 428/2933* (2015.01)

(58) Field of Classification Search
CPC ..... H01B 7/0225; H01B 3/306; H01B 3/308; H01F 27/2823; Y10T 428/2933
USPC ..... 428/375
See application file for complete search history.

(56) References Cited

U.S. PATENT DOCUMENTS

2003/0024729 A1* 2/2003 Suzuki et al. ..... 174/117 FF
2004/0254258 A1* 12/2004 Horikoshi ..... C08G 75/08 523/102
2010/0319961 A1* 12/2010 Honda et al. ..... 174/120 SR
2011/0048766 A1* 3/2011 Kikuchi et al. ..... 174/110 SR

FOREIGN PATENT DOCUMENTS

JP 2000-235818 A 8/2000
JP 2010-205542 A 9/2010
JP 2011-9015 1/2011

OTHER PUBLICATIONS

English translation of JP2011-009015.*

(Continued)

*Primary Examiner* — Steven T Sawyer
(74) *Attorney, Agent, or Firm* — Finnegan, Henderson, Farabow, Garrett & Dunner LLP

(57) ABSTRACT

According to one embodiment, an insulated electric wire is disclosed. The insulated electric wire includes a conductor and an insulating film formed on the conductor, the insulating film including a first layer of a first polyamideimide containing an adhesion improver, a second layer of a second polyamideimide obtained by reacting an isocyanate component containing 10 to 70 mol % in total of 2,4'-diphenylmethane diisocyanate and dimer acid diisocyanate react with an acid component formed on the first layer, and a third layer of a polyimide formed on the second layer.

16 Claims, 1 Drawing Sheet

(56) References Cited

OTHER PUBLICATIONS

ChemSpider—Toluene diisocyanate; Royal Society of Chemistry; Nov. 2012.*

Office Action mailed Jun. 5, 2015, in French Patent Application No. 13 57013.

Comments from agent in France sent on Jun. 24, 2015, regarding Office Action mailed on Jun. 5, 2015, in French Patent Application No. 13 57013.

* cited by examiner

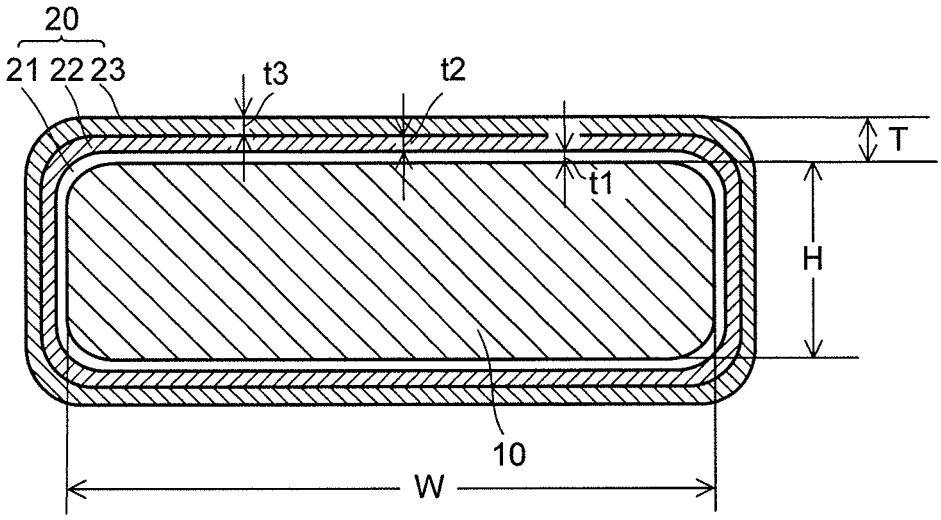
20
21 22 23
t3
t2
t1
T
H
10
W

INSULATED ELECTRIC WIRE

CROSS REFERENCE TO RELATED APPLICATION

This application is based upon and claims the benefit of priority from the prior Japanese Patent Application No. 2012-162117, filed on Jul. 20, 2012; the entire contents of which are incorporated herein by reference.

FIELD

Embodiments described herein relate generally to an insulated electric wire which may be used for a coil of a motor and so on.

BACKGROUND

As electronic and electric devices have been miniaturized in recent years, the mainstream of coils to be attached inside such devices is changing from one using a conventional enameled wire with a circular cross section (circular enameled wire) to one using an enameled wire with a rectangular cross section (rectangular enameled wire). The rectangular enameled wire is made as a result that an insulating varnish is applied onto a conductor with a rectangular cross section (rectangular conductor) and baked, to form an insulating film. By using the rectangular enameled wire, a gap between the enameled wires when being wound into a coil can be made smaller (that is, a space factor of the enameled wire can be heightened), enabling miniaturization of the coil. Recently, in order to further miniaturize a coil, a diameter of an enameled wire is being made smaller.

For the insulating film of the enameled wire used for the coil of the motor, a resin good in a flexibility and also comparatively superior in a heat resistance, such as a polyesterimide and a polyamideimide, has been broadly used. However, the resin such as a polyesterimide and a polyamideimide, though superior in a heat resistance, is not necessarily enough since a heat resistant temperature of an enameled wire using such a resin as an insulating film material is about 200° C. Further, such a resin has a low heat deterioration resistance, and thus a fracture, a crack, a peeling from a conductor or the like sometimes occurs in the insulating film when the enameled wire is heat-deteriorated after a severe processing stress such as coiling is applied or subjected to a processing stress after being heat-deteriorated.

For such a problem, an insulated electric wire is proposed in which an insulating varnish to which an adhesion improver is added, such as high adhesion polyesterimide or highly adhesive polyamideimide, is applied to a conductor and baked, and an aromatic polyamide film is formed in an outer periphery thereof. This insulated electric wire is improved in an adhesion to a conductor of an insulating film, and a heat resistance and a heat deterioration resistance are enhanced.

However, because of formation of the aromatic polyimide film, a flexibility of the insulating film of the insulated electric wire is decreased, so that a fracture or a crack is apt to occur in the insulating film at a time of coiling. In particular, in the above-described rectangular enameled wire with a small size, a processing stress received when coiling is severer, and it is difficult to endure such a processing.

SUMMARY

An object of the present invention is to provide an insulated electric wire which has a processing resistance superior enough to endure a severe processing stress and is also quite superior in a heat resistance and a heat deterioration resistance.

An insulated electric wire according to an embodiment of the present invention includes a conductor and an insulating film formed on the conductor, the insulating film including a first layer formed from a first polyamideimide containing an adhesion improver, a second layer of a second polyamideimide obtained by reacting an isocyanate component containing 10 to 70 mol % in total of 2,4'-diphenylmethane diisocyanate and dimer acid diisocyanate with an acid component formed on the first layer, and a third layer of a polyimide formed on the second layer.

BRIEF DESCRIPTION OF THE DRAWINGS

FIG. 1 is a cross-sectional view showing an insulated electric wire according to an embodiment.

DETAILED DESCRIPTION

According to an embodiment of the present invention, there is provided an insulated electric wire which has a processing resistance superior enough to endure a severe processing stress at a time of coiling and is also quite superior in a heat resistance and a heat deterioration resistance.

Hereinafter, the embodiment of the present invention will be described. Explanation will be done based on the drawing, but the drawing is provided merely for an illustration and the present invention is not limited by the drawing in any way.

FIG. 1 is a transverse cross-sectional view showing a rectangular enameled wire according to an embodiment of the insulated electric wire of the present invention.

As shown in FIG. 1, this rectangular enameled wire has a rectangular conductor 10 with a rectangular cross section formed by wire drawing, and an insulating film 20 with three-layer structure formed in sequence on the rectangular conductor 10, that is, a film formed of a first layer 21, a second layer 22, and a third layer 23.

The rectangular conductor 10 is formed of a metal wire which has a rectangular cross section, for example, with a width (W) of 2.0 to 7.0 mm and a thickness (H) of 0.7 to 3.0 mm, such as a copper wire, a copper alloy wire, an aluminum wire and an aluminum alloy wire. Four corner portions in the rectangular cross section may be chamfered or not, but in view of heightening a space factor at a time of winding into a coil, it is preferable that they are not chamfered (that is, the cross section is rectangular) or, even when they are chamfered, each radius is equal to or less than 0.4 mm. Examples of materials of the rectangular conductor 10, but are not limited to, a copper alloy, an aluminum, and an aluminum alloy, and in addition, an iron, a silver and alloys thereof. In view of a mechanical strength, a conductivity and the like, a copper or a copper alloy is preferable.

The first layer 21 is a layer of a polyamideimide containing an adhesion improver (also referred to as a highly adhesive polyamideimide or a first polyamideimide), and can be formed as a result that a polyamideimide resin varnish (highly adhesive polyamideimide resin varnish), to which an adhesion improver is added, is applied onto a rectangular conductor 10 and baked.

In general, the polyamideimide resin varnish can be obtained by making a tricarboxylic acid or a delivertive thereof react with a diisocyanate and/or a diamine in an organic solvent. Here, one whose adhesion is heightened as a result of addition of an adhesion improver to such a polyamideimide resin varnish is used.

Examples of the tricarboxylic acids and the delivertives thereof include trimellitic anhydride, trimellitic anhydride monochloride. Examples of the diisocyanates include aliphatic diisocyanates such as trimethylene diisocyanate, tetramethylene diisocyanate and trimethyl hexamethylene diisocyanate, an aromatic diisocyanate such as a 4,4'-diphenylmethane diisocyanate, a 4,4'-diphenylether diisocyanate, a 2,4- or 2,6-tolylene diisocyanate and an m- or p-xylene diisocyanate, delivertive such as diisocyanates blocked by phenols, and so on. Examples of the diamines include aliphatic diamines such as ethylene diamine and hexamethylene diamine, aromatic diamines such as m-phenylenediamine, p-phenylenediamine, 2,4-diaminotoluene, 4,4'-diamino-3,3'-dimethyl-1,1'-biphenyl, 4,4'-diamino-3,3'-dihydroxy-1,1'-biphenyl, 3,4'-diaminodiphenylether, 4,4'-diaminodiphenylether, 3,3'-diaminodiphenylsulfone, 4,4'-diaminodiphenylsulfone, 4,4'-diaminodiphenylsulfide, 2,2-bis(4-aminophenyl)propane, 2,2-bis(4-aminophenyl) hexafluoropropane, 1,3-bis(4-aminophenoxy)benzene, 1,4-bis(4-aminophenoxy)benzene, 4,4'-bis(4-aminophenoxy) biphenyl, 2,2-bis[4-(4-aminophenoxy) phenyl]propane, 2,2-bis[4-(4-aminophenoxy)phenyl]hexafluoropropane, bis[4-(3-aminophenoxy)phenyl]sulfone and a bis[4-(4-aminophenoxy)phenyl]sulfone, and further, 2,6-diaminopyridine, 2,6-diamino-4-methylpyridine, 4,4'-(9-fluorenyliden)dianiline, α,α-bis(4-aminophenyl)-1,3-diisopropylbenzene, and so on. Examples of reaction solvents, aprotic polar solvents such as 2-pyrrolidone, N-methyl-2-pyrrolidone and N,N-dimethylacetamide, phenolic solvents such as phenol, cresol and xylenol, and so on. Examples of the adhesion improvers include thiadiazole, thiazole, mercaptobenzimidazole, thiophenol, thiophene, thiol, tetrazole, benzimidazole, butylated melamine, heterocyclic mercaptan, and so on.

Varieties of polyamideimide resin varnishes to which adhesion improvers are added are available commercially, and it is possible to appropriately select and use one or more from such marketed productions. Specifically, the productions are, for example, AI-505 from Totoku Toryo Co., Ltd. and HI-406A from Hitachi Chemical Co., Ltd (hereinabove, product names), and so on.

Preferably, the highly adhesive polyamideimide constituting the first layer 21 has a glass transition point (Tg) of 250 to 300° C., and more preferably 255 to 270° C.

The second layer 22 is a layer of a polyamideimide (also referred to as a highly flexible polyamideimide or a second polyamideimide) obtained by making an isocyanate component containing a 2,4'-diphenylmethane diisocyanate and a dimer acid diisocyanate react with an acid component, and is formed as a result that a resin varnish containing a highly flexible polyamideimide is applied onto the first layer 21 and baked.

Hereinafter, the highly flexible polyamideimide resin varnish used for forming the second layer 22 will be described.

For the highly flexible polyamideimide resin varnish, 2,4'-diphenylmethane diisocyanate (2,4'-MDI) and dimer acid diisocyanate are used as the isocyanate component. As a result of using the above isocyanate component, the second layer 22 superior in a flexibility is formed, so that a superior processing resistance can be given to an insulated electric wire. Preferably, the sum of the 2,4'-MDI and the dimmer acid diisocyanate is 10 to 70 mol % of the isocyanate component, and more preferably 30 to 60 mol %.

Examples of other isocyanates to be used in combination with the above isocyanates are 4,4'-diphenylmethane diisocyanate (4,4'-MDI), 3,4'-diphenylmethane diisocyanate, 3,3'-diphenylmethane diisocyanate, 2,3'-diphenylmethane diisocyanate, 2,2'-diphenylmethane diisocyanate, tolylene diisocyanate (TDI), diphenylether diisocyanate, naphthalene diisocyanate, phenylene diisocyanate, a xylylene diisocyanate, diphenylsulfone diisocyanate, bitolylene diisocyanate, dianisidine diisocyanate, isomers thereof and so on. Further, there can also be combined aliphatic diisocyanates such as hexamethylene diisocyanate, isopholone diisocyanate, methylene dicyclohexyl diisocyanate, xylylene diisocyanate and cyclohexane diisocyanate; polyfunctional isocyanates such as triphenylmethane triisocyanate; polymers such as polymeric isocyanate, tolylene diisocyanate and so on.

Examples of the acid component are aromatic tetracarboxylic dianhydride such as trimellitic anhydride (TMA), pyromellitic dianhydride (PMDA), a benzophenone tetracarboxylic dianhydride (BTDA), biphenyl tetracarboxylic dianhydride, diphenylsulfone tetracarboxylic dianhydride (DSDA) and oxydiphthalic dianhydride, and isomers thereof; alicyclic tetracarboxylic dianhydrides such as butanetetracarboxylic dianhydride, 5-(2,5-dioxotetrahydro-3-furanyl)-3-methyl-3-cyclohexene-1,2-dicarboxylic anhydride; tricarboxylic acids and isomers thereof such as trimesic acid and tris(2-carboxyethyl)isocyanurate (CIC acid) and so on. Among the above, trimelliticanhydride (TMA), which is inexpensive and superior in safety, is preferable.

Polycarboxylic acids can be added other than the above-described isocyanate component and acid component. Examples of the polycarboxylic acids are aromatic dicarboxylic acids such as terephthalic acid and isophthalic acid, aromatic tricarboxylic acids such as trimellitic acid and hemimellitic acid, aliphatic polycarboxylic acids such as a dimer acid, and so on.

Examples of solvents to make the isocyanate component react with the acid component include aprotic polar solvents such as 2-pyrrolidone, N-methyl-2-pyrrolidone (NMP) and N,N-dimethylacetamide, phenolic solvents such as phenol, cresol and xylenol, and so on.

When making the isocyanate component react with the acid component, reaction catalysts such as amines, imidazoles and imidazolines can be used. Preferably, the reaction catalysts are those that do not reduce a stability of the resin varnish.

Preferably, the highly flexible polyamideimide constituting the second layer 22 has a glass transition point (Tg) of 200 to 270° C., more preferably 230 to 260° C.

The third layer 23 is a layer of a polyimide, and is formed as a result that a polyimide resin varnish is applied onto the second layer 22 and baked. Preferably, the polyimide resin varnish is selected from wholly aromatic polyimide resin varnishes obtained by making one or more tetracarboxylic dianhydride(s) selected from pyromellitic acid dianhydride (PMDA), benzophenone tetracarboxylic dianhydride (BTDA) and 3,3',4,4'-biphenyl tetracarboxylic dianhydride react with aromatic diamines such as 4,4'-diaminodiphenyl ether, or aromatic diisocyanates, in organic solvents such as N-methyl-2-pyrrolidone and N,N'-dimethylacetamide (DMAc). Examples of marketed products of wholly aromatic polyimide resin varnishes suitable for forming the third layer 23 are Toraynese #3000 from Toray Industries, Inc. and U-Varnish-A from Ube Industries, Ltd. (hereinabove, product names).

As described above, the first layer 21, the second layer 22, and the third layer 23 can be formed as a result that the highly adhesive polyamideimide resin varnish, the highly flexible polyamideimide resin varnish, and the polyimide resin varnish are applied in sequence, respectively, onto the rectangular conductor 10 and baked. Methods for applying and baking the respective resin varnishes are not limited in particular, but there can be used methods known in general, for example, a method in which a rectangular conductor or a rectangular conductor where a first layer or a second layer has been formed is made to pass through a tank containing a resin varnish and thereafter baked in a baking furnace.

With regard to respective layer thicknesses (t1, t2 and t3) of the first layer 21, the second layer 22, and the third layer 23, it is preferable that a thickness of a sum thereof, that is, a thickness (T) of the insulating film 20 being 60 to 200 μm, the first layer 21 is 10 to 20%, the second layer 22 is 10 to 75%, and the third layer 23 is 10 to 75% in a proportion of each layer in relation to the thickness of the insulating film 20. When the thickness of the first layer 21 is less than a range described above, an adhesion to the rectangular conductor 10 is reduced and a peeling from the rectangular conductor 10 occurs. When the thickness of the second layer 22 is less than a range described above, a processing resistance cannot be improved sufficiently. When the thickness of the third layer 23 is less than a range described above, a heat resistance and a heat deterioration resistance are reduced. When the thickness (T) of the insulating film 20 is less than 60 μm, a partial discharge property is insufficient, and when the thickness exceeds 200 μm, the insulating film 20 is too thick and miniaturization of a coil is difficult. More preferably, the thickness (T) of the insulating film 20 is 60 to 160 μm, and more preferably, the first layer 21 is 15 to 20%, the second layer 22 is 55 to 70%, and the third layer 23 is 15 to 30% in the proportion of each layer in relation to the thickness of the insulating film 20.

The small-sized rectangular enameled wire of the present embodiment has, on the rectangular conductor 10, the insulating film 20 constituted by the first layer 21 of the polyamideimide containing the adhesion improver, the second layer 22 of the second polyamideimide obtained by making the isocyanate component containing 10 to 70 mol % in total of the 2,4'-diphenylmethane diisocyanate and the dimer acid diisocyanate react with the acid component, the second layer 22 provided on the first layer 21, and the third layer 23 of the polyimide provided on the second layer 22. Thus, it is possible to have a processing resistance superior enough to endure a severe processing stress at a time of coiling and good heat resistance and heat deterioration resistance.

Hereinabove, though one embodiment of the present invention is described, the present invention is not limited to the above-described embodiment as it is and in an execution phase components can be modified and materialized without departing from the scope of the gist thereof. For example, the above-described embodiment is an example of application of the present invention to the rectangular enameled wire, but it is a matter of course that the present invention can be applied to a circular enameled wire using a common circular conductor, and so on. The insulated electric wire of the present invention, though being small-sized, can have a superior processing resistance, good heat resistance and heat deterioration resistance. Thus, the insulated electric wire of the present invention is useful for an insulated electric wire using a small-size conductor, and is useful, in particular, for an insulated electric wire using a rectangular conductor which receives quite a severe processing stress at a time of coiling.

EXAMPLE

Hereinafter, the present invention will be concretely described in examples, but the present invention should not be limited to these examples in anyway. In the following description, "part" means "part by mass" unless it is explicitly stated otherwise.

[Preparation of Polyamideimide Resin Varnish]

Preparation Example 1

Into a flask having a stirring mechanism, a nitrogen inflow tube and a heating/cooling device, there were fed a mixture of a 2,4'-MDI and 4,4'-MDI as well as a dimer acid diisocyanate (DDI) as an isocyanate component and a trimellitic acid anhydrate as an acid component. As a solvent, 150 parts of N-methyl-2-pyrrolidone was fed in relation to 100 parts in total of acid and isocyanate components, and a temperature was raised from a room temperature to 140° C., taking two hours, while stirring was performed under a nitrogen atmosphere. After reaction was performed at that temperature for three hours, dilution with 83 parts of N,N-dimethylformamide (DMF) was performed, cooling to the room temperature was performed, and a polyamideimide resin varnish (B-1) with a resin content of 30 mass % was obtained.

Preparation Examples 2 to 11

Polyamideimide resin varnishes (B-2) to (B-11) were obtained in similar methods as in preparation example 1, with proportions of isocyanate components being changed as shown in Table 1.

TABLE 1

| | | polyamideimide resin varnish | | | | | | | | | | |
|---|---|---|---|---|---|---|---|---|---|---|---|---|
| | | B-1 | B-2 | B-3 | B-4 | B-5 | B-6 | B-7 | B-8 | B-9 | B-10 | B-11 |
| isocyanate component (mol) | 4,4'-MDI | 0.60 | 0.50 | 0.40 | 0.90 | 0.70 | 0.30 | 0.30 | 0.80 | 0.95 | 0.50 | 0.70 |
| | 2,4'-MDI | 0.30 | 0.25 | 0.30 | 0.05 | 0.15 | 0.35 | 0.40 | 0.20 | 0.05 | 0.50 | — |
| | DDI | 0.10 | 0.25 | 0.30 | 0.05 | 0.15 | 0.35 | 0.40 | — | — | — | 0.30 |
| acid component (mol) | TMA | 1.05 | 1.05 | 1.05 | 1.05 | 1.05 | 1.05 | 1.05 | 1.05 | 1.05 | 1.05 | 1.05 |
| mole ratio (2,4'-MDI + DDI)/all isocyanates (%) | | 40 | 50 | 60 | 10 | 30 | 70 | 80 | 20 | 5 | 50 | 30 |

[Manufacturing of Insulated Electric Wire]

Example 1

Onto a rectangular copper conductor with a thickness of 1.9 mm and a width of 3.4 mm, a polyamideimide resin varnish containing an adhesion improver (product name: AI-505, from Totoku Toryo Co., Ltd.; abbreviation:"HAPAI" in the following tables) was applied and baked, to form a film (first layer) with a thickness of 20 μm. Next, onto the first layer, a polyamideimide resin varnish (B-1) shown in Table 1 was applied and baked, to form a film (second layer) with a thickness of 60 Onto the second layer, a polyimide resin varnish (product name: Toraynese #3000, from Toray Industries, Inc.; abbreviation:"PI" in the following tables) was applied and baked, to form a film (third layer) with a thickness of 20 μm, so that an insulated electric wire is obtained.

Examples 2 to 20

An insulated electric wire was obtained similarly to in example 1, except that at least one condition of a kind or a size of a rectangular conductor, a kind of a polyamideimide resin varnish used for forming the second layer, and film thicknesses of the first layer to the third layer was changed.

Comparative Example 1 to 12

An insulated electric wire was obtained by a constitution and dimension shown in Table 3.

With regard to each insulated electric wire obtained, each property was measured and evaluated in methods described below.

[Glass Transition Point (Tg)]

Glass transition points (Tg) of materials constituting the first layer and the second layer are measured by using a thermomechanical analyzer.

[Heat Deterioration Resistance]

After an insulated electric wire sample with a length of 30 cm is heat-deteriorated at 250° C. for 48 hours, a tensile test is performed under a condition of a gage length of 10 cm and a tensile speed of 3 mm/min, and an evaluation is done according to the criteria below.

A: neither fracture nor crack of an insulating film occurs by an elongation of equal to or more than 7 mm.

B: neither fracture nor crack of an insulating film occurs by an elongation of equal to or more than 3 mm and less than 7 mm.

C: neither fracture nor crack of an insulating film occurs by an elongation of equal to or more than 2 mm and less than 3 mm.

D: a fracture or a crack of an insulating film occurs by an elongation of less than 2 mm.

[Processing Resistance (Flexibility)]

An insulated electric wire sample with a length of 25 cm is extended by 30% and an edgewise bend test is performed, and then an evaluation is done according to the criteria below (n=40).

A: no crack occurs.

B: a crack occurrence rate is less than 5%.

C: a crack occurrence rate is equal to or more than 5% and less than 10%.

D: a crack occurrence rate is equal to or more than 10%.

[Adhesion]

A 180° peeling test of an insulating film and a conductor is performed, and an adhesion (g/mm) of the insulating film is measured.

[Abrasion Resistance]

A reciprocal abrasion test between insulated electric wires is performed under a condition of an abrasion length of 4000 m and a load of 1.2 kg by using an abrasion tester, and an evaluation is done according to the criteria below.

A: a film remaining rate is about 100%.

B: a film remaining rate is equal to or more than 80%.

C: a film remaining rate is equal to or more than 50% and less than 80%.

D: a film remaining rate is less than 50%.

Measured results of the above are shown in Table 2 to Table 5 with a constitution, a dimension and the like of each insulated electric wire.

TABLE 2

| | material | | | | conductor size (mm) | | insulating film thickness (μm)* | | | |
|---|---|---|---|---|---|---|---|---|---|---|
| | conductor | first layer** | second layer | third layer | thickness | width | Total | first layer | second layer | third layer |
| Example 1 | copper | HAPAI | B-1 | PI | 1.9 | 3.4 | 100 | 20 (20) | 60 (60) | 20 (20) |
| Example 2 | copper | HAPAI | B-1 | PI | 2.0 | 3.5 | 140 | 20 (20) | 95 (68) | 25 (18) |
| Example 3 | copper | HAPAI | B-1 | PI | 2.0 | 3.5 | 160 | 24 (15) | 108 (68) | 28 (18) |
| Example 4 | copper | HAPAI | B-1 | PI | 1.6 | 2.4 | 100 | 15 (15) | 60 (60) | 25 (25) |
| Example 5 | copper | HAPAI | B-1 | PI | 1.9 | 3.4 | 100 | 15 (15) | 25 (25) | 60 (60) |
| Example 6 | copper | HAPAI | B-1 | PI | 1.9 | 3.4 | 100 | 15 (15) | 45 (45) | 40 (40) |
| Example 7 | copper | HAPAI | B-1 | PI | 1.9 | 3.4 | 100 | 20 (20) | 55 (55) | 25 (25) |
| Example 8 | copper | HAPAI | B-1 | PI | 1.9 | 3.4 | 100 | 20 (20) | 65 (65) | 15 (15) |
| Example 9 | copper | HAPAI | B-1 | PI | 1.9 | 3.4 | 100 | 20 (20) | 75 (75) | 5 (5) |
| Example 10 | copper | HAPAI | B-1 | PI | 1.9 | 3.4 | 100 | 20 (20) | 8 (8) | 72 (72) |
| Example 11 | copper | HAPAI | B-1 | PI | 1.9 | 3.4 | 100 | 15 (15) | 80 (80) | 5 (5) |
| Example 12 | copper | HAPAI | B-1 | PI | 1.9 | 3.4 | 100 | 5 (5) | 65 (65) | 30 (30) |
| Example 13 | copper | HAPAI | B-2 | PI | 1.9 | 3.4 | 100 | 20 (20) | 60 (60) | 20 (20) |

TABLE 2-continued

| | material | | | | conductor size (mm) | | insulating film thickness (μm)* | | | |
|---|---|---|---|---|---|---|---|---|---|---|
| | conductor | first layer** | second layer | third layer | thickness | width | Total | first layer | second layer | third layer |
| Example 14 | copper | HAPAI | B-3 | PI | 1.9 | 3.4 | 100 | 20 (20) | 60 (60) | 20 (20) |
| Example 15 | copper | HAPAI | B-4 | PI | 1.9 | 3.4 | 100 | 20 (20) | 60 (60) | 20 (20) |
| Example 16 | copper | HAPAI | B-5 | PI | 1.9 | 3.4 | 100 | 20 (20) | 60 (60) | 20 (20) |
| Example 17 | copper | HAPAI | B-6 | PI | 1.9 | 3.4 | 100 | 20 (20) | 60 (60) | 20 (20) |
| Example 18 | copper | HAPAI | B-1 | PI | 1.9 | 3.4 | 220 | 44 (20) | 132 (60) | 44 (20) |
| Example 19 | Aluminium | HAPAI | B-1 | PI | 1.9 | 3.4 | 100 | 20 (20) | 60 (60) | 20 (20) |
| Example 20 | Aluminium | HAPAI | B-1 | PI | 1.9 | 3.4 | 100 | 15 (15) | 60 (60) | 25 (25) |

*Value in the bottom of each cell is thickness ratio relative to total thickness of the insulation film (unit: %).
**HAPAI: highly adhesive PAI

TABLE 3

| | glass transition point (° C.) | | heat deterio- | processing | adhe- | abrasion |
|---|---|---|---|---|---|---|
| | first layer | second layer | ration resistance | resistance (flexibility) | sion (g/mm) | resist-ance |
| Example 1 | 266 | 246 | A | A | 49 | A |
| Example 2 | 266 | 246 | A | A | 64 | A |
| Example 3 | 266 | 246 | A | A | 53 | A |
| Example 4 | 266 | 246 | A | A | 44 | A |
| Example 5 | 266 | 246 | A | B | 51 | B |
| Example 6 | 266 | 246 | A | B | 55 | A |
| Example 7 | 266 | 246 | A | A | 58 | A |
| Example 8 | 266 | 246 | A | A | 65 | A |
| Example 9 | 266 | 246 | A | A | 62 | A |
| Example 10 | 266 | 246 | A | B | 64 | B |
| Example 11 | 266 | 246 | B | A | 55 | A |
| Example 12 | 266 | 246 | A | B | 43 | A |

TABLE 3-continued

| | glass transition point (° C.) | | heat deterio- | processing | adhe- | abrasion |
|---|---|---|---|---|---|---|
| | first layer | second layer | ration resistance | resistance (flexibility) | sion (g/mm) | resist-ance |
| Example 13 | 266 | 232 | A | A | 58 | A |
| Example 14 | 266 | 222 | A | A | 63 | A |
| Example 15 | 266 | 270 | A | A | 57 | A |
| Example 16 | 266 | 256 | A | A | 61 | A |
| Example 17 | 266 | 200 | A | A | 63 | A |
| Example 18 | 266 | 246 | A | B | 53 | A |
| Example 19 | 266 | 246 | A | A | 54 | A |
| Example 20 | 266 | 246 | A | A | 46 | A |

TABLE 4

| | material | | | | conductor size (mm) | | insulating film thickness (μm)* | | | |
|---|---|---|---|---|---|---|---|---|---|---|
| | conductor | first layer** | second layer | third layer | thickness | width | Total | first layer | second layer | third layer |
| Comparative Example 1 | copper | HAPAI | B-7 | PI | 1.9 | 3.4 | 100 | 20 (20) | 65 (65) | 15 (15) |
| Comparative Example 2 | copper | HAPAI | B-8 | PI | 1.9 | 3.5 | 100 | 20 (20) | 65 (65) | 15 (15) |
| Comparative Example 3 | copper | HAPAI | B-9 | PI | 1.9 | 3.5 | 160 | 20 (20) | 65 (65) | 15 (15) |
| Comparative Example 4 | copper | HAPAI | B-10 | PI | 1.9 | 2.4 | 100 | 20 (20) | 65 (65) | 15 (15) |
| Comparative Example 5 | copper | HAPAI | B-11 | PI | 1.9 | 3.4 | 100 | 20 (20) | 65 (65) | 15 (15) |
| Comparative Example 6 | copper | HAPAI | B-1 | PI | 1.9 | 3.4 | 100 | 5 (5) | 75 (75) | 20 (20) |
| Comparative Example 7 | copper | HAPAI | B-1 | PI | 1.9 | 3.4 | 100 | 10 (10) | 10 (10) | 80 (80) |
| Comparative Example 8 | copper | HAPAI | B-1 | PI | 1.9 | 3.4 | 100 | 30 (30) | 5 (5) | 65 (65) |
| Comparative Example 9 | copper | HAPAI | B-1 | PI | 1.9 | 3.4 | 50 | 5 (10) | 40 (80) | 5 (10) |

TABLE 4-continued

| | material | | | | conductor size (mm) | | insulating film thickness (μm)* | | | |
|---|---|---|---|---|---|---|---|---|---|---|
| | conductor | first layer** | second layer | third layer | thickness | width | Total | first layer | second layer | third layer |
| Comparative Example 10 | copper | HAPAI | g.u.PAI | PI | 1.9 | 3.4 | 100 | 20 (20) | 65 (65) | 15 (15) |
| Comparative Example 11 | copper | g.u.PAI | — | — | 1.0 | 5.0 | 50 | 50 (100) | — | — |
| Comparative Example 12 | copper | HAPAI | PI | — | 1.9 | 3.4 | 50 | 35 (70) | 15 (30) | — |

*Value in the bottom of each cell is thickness ratio relative to total thickness of the insulation film (unit: %).
**HAPAI: highly adhesive PAI
g.u.PAI: general-use PAI (product name: HI-406, from Hitachi Co., Ltd.)

TABLE 4

| | glass transition point (° C.) | | heat deterio- | processing resistance | adhe- | abrasion |
|---|---|---|---|---|---|---|
| | first layer | second layer | ration resistance | (flexi-bility) | sion (g/mm) | resist-ance |
| Comparative Example 1 | 266 | 195 | D | C | 60 | B |
| Comparative Example 2 | 266 | 267 | B | D | 54 | B |
| Comparative Example 3 | 266 | 276 | B | D | 52 | B |
| Comparative Example 4 | 266 | 235 | C | D | 52 | B |
| Comparative Example 5 | 266 | 218 | D | D | 45 | B |
| Comparative Example 6 | 266 | 246 | A | A | 18 | B |
| Comparative Example 7 | 266 | 246 | A | C | 56 | D |
| Comparative Example 8 | 266 | 246 | A | D | 62 | C |
| Comparative Example 9 | 266 | 246 | D | B | 16 | B |
| Comparative Example 10 | 266 | 288 | A | D | 50 | B |
| Comparative Example 11 | 288 | — | D | D | 7 | B |
| Comparative Example 12 | 266 | — | C | D | 55 | C |

As is obvious from Table 2 to Table 5, the insulated electric wire of the example is superior in a processing resistance and superior in a heat resistance and a heat deterioration resistance.

Since an insulated electric wire of the present invention is superior in a processing resistance and quite superior in a heat resistance and a heat deterioration resistance, the insulated electric wire of the present invention is suitable as an insulated electric wire used for forming a coil where miniaturization is required.

What is claimed is:

1. An insulated electric wire, comprising:

a conductor and an insulating film formed on the conductor, the insulating film comprising a first layer of a first polyamideimide containing an adhesion improver, a second layer of a second polyamideimide obtained by reacting an isocyanate component containing 2,4'-diphenylmethane diisocyanate, dimer acid diisocyanate and 4,4'-diphenyl methane diisocyanate with an acid component formed on the first layer, and a third layer of a polyimide formed on the second layer, wherein the isocyanate component contains 10 to 70 mol % of 2,4'-diphenylmethane diisocyanate and dimer acid diisocyanate, and 30 to 90 mol % of 4,4'-diphenylmethane diisocyanate, and wherein with regard to a proportion of thicknesses of the first to third layers in relation to the total thickness of the insulating film, the first layer is 10 to 20% , the second layer is 10 to 75% , and the third layer is 10 to 75% .

2. The insulated electric wire according to claim 1, wherein a glass transition point (Tg) of the first polyamideimide is 250 to 300° C.

3. The insulated electric wire according to claim 1, wherein a glass transition point (Tg) of the second polyamideimide is 200to 270° C.

4. The insulated electric wire according to claim 1, wherein the isocyanate component contains 30 to 60 mol % of 2,4'-diphenylmethane diisocyanate and dimer acid diisocyanate.

5. The insulated electric wire according to claim 1, wherein the acid component is selected from an aromatic tetracarboxylic acid dianhydride and an isomer thereof.

6. A insulated electric wire according to claim 1, wherein the total thickness of the insulating film is 60 to 200 μm.

7. The insulated electric wire according to claim 1, wherein the conductor is a rectangular conductor.

8. The insulated electric wire according to claim 1, wherein the rectangular conductor has a rectangular cross section with a width of 2.0 to 7.0 mm and a height of 0.7 to 3.0 mm.

9. An insulated electric wire, comprising:

a conductor and an insulating film formed on the conductor, the insulating film comprising a first layer of a first polyamideimide containing an adhesion improver, a second layer of a second polyamideimide obtained by reacting an isocyanate component containing 2,4'-diphenylmethane diisocyanate, dimer acid diisocyanate and 4,4'-diphenylmethane diisocyanate with an acid component formed on the first layer, and a third layer of a polyimide formed on the second layer, wherein. the isocyanate component contains 10 to 70 mol % of 2,4'- diphenvlmethane diisocyanate and dimer acid diisocyanate, and 30 to 90 mol % of 4,4'-diphenvlmethane diisocyanate, and wherein, with regard to a proportion of thicknesses of the first to third layers in relation to the total thickness of the insulating film, the first layer is 15 to 20%, the second layer is 55 to 75%, and the third layer is 15 to 30%.

10. The insulated electric wire according to claim 9, wherein a glass transition point (Tg) of the first polvamideimide is 250 to 300° C.

11. The insulated electric wire according to claim 9, wherein a glass transition point (Tg) of the second polvamideimide is 200 to 270° C.

12. The insulated electric wire according to claim 9, wherein the isocyanate component contains 30 to 60 mol % in total of 2,4'-diphenylmethane diisocyanate and dimer acid diisocyanate.

13. The insulated electric wire according to claim 9, wherein the acid component is selected from an aromatic tetracarboxylic acid dianhydride and an isomer thereof.

14. A insulated electric wire according to claim 9, wherein the total thickness of the insulating film is 60 to 200 μm.

15. The insulated electric wire according to claim 9, wherein the conductor is a rectangular conductor.

16. The insulated electric wire according to claim 9 wherein the rectangular conductor has a rectangular cross section with a width of 2.0 to 7.0 mm and a height of 0.7 to 3.0 mm.

* * * * *